US007052124B2

(12) United States Patent
Pickup

(10) Patent No.: US 7,052,124 B2
(45) Date of Patent: May 30, 2006

(54) INK ASSIST AIR KNIFE

(75) Inventor: Ray L. Pickup, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/086,946

(22) Filed: Feb. 28, 2002

(65) Prior Publication Data

US 2003/0160852 A1 Aug. 28, 2003

(51) Int. Cl.
*B41J 2/01* (2006.01)

(52) U.S. Cl. ..... 347/102; 347/101

(58) Field of Classification Search ..... 347/101, 347/102, 104; 101/488; 399/320
See application file for complete search history.

(56) References Cited

U.S. PATENT DOCUMENTS

| | | | | |
|---|---|---|---|---|
| 3,950,650 | A | 4/1976 | Pray et al. | |
| 4,089,123 | A | 5/1978 | Ericsson et al. | |
| 4,678,312 | A * | 7/1987 | Shiozawa et al. | 399/130 |
| 4,903,082 | A | 2/1990 | Dyer et al. | |
| 5,020,244 | A * | 6/1991 | Smith | 34/633 |
| 5,117,562 | A | 6/1992 | Dulay et al. | |
| 5,173,988 | A * | 12/1992 | Bhatia et al. | 15/309.2 |
| 5,317,127 | A | 5/1994 | Brewster, Jr. et al. | |
| 5,356,229 | A | 10/1994 | Hickman et al. | |
| 5,393,151 | A | 2/1995 | Martin et al. | |
| 5,396,270 | A | 3/1995 | Gooray et al. | |
| 5,406,316 | A | 4/1995 | Schwiebert et al. | |
| 5,420,621 | A | 5/1995 | Richtsmeier et al. | |
| 5,428,384 | A * | 6/1995 | Richtsmeier et al. | 347/102 |
| 5,446,487 | A | 8/1995 | Russell et al. | |
| 5,447,566 | A | 9/1995 | Loiacono | |
| 5,467,119 | A | 11/1995 | Richtsmeier et al. | |
| 5,495,275 | A * | 2/1996 | Martinengo | 347/112 |
| 5,500,668 | A | 3/1996 | Malhotra et al. | |
| 5,537,925 | A | 7/1996 | Secor et al. | |
| 5,563,644 | A | 10/1996 | Isganitis et al. | |
| 5,589,866 | A * | 12/1996 | Russell et al. | 347/102 |
| 5,625,398 | A | 4/1997 | Milkovits et al. | |
| 5,631,685 | A | 5/1997 | Gooray et al. | |
| 5,633,668 | A | 5/1997 | Schwiebert et al. | |
| 5,757,407 | A | 5/1998 | Rezanka | |
| 5,774,141 | A | 6/1998 | Cooper et al. | |
| 5,774,155 | A | 6/1998 | Medin et al. | |
| 6,146,770 | A | 11/2000 | Sargeant et al. | |
| 6,231,176 | B1 | 5/2001 | Peter | |
| 6,283,590 | B1 * | 9/2001 | Peter | 347/102 |
| 6,293,196 | B1 | 9/2001 | DeMoore et al. | |
| 6,439,712 | B1 * | 8/2002 | Mizutani et al. | 347/102 |
| 6,463,674 | B1 * | 10/2002 | Meyers et al. | 34/304 |

FOREIGN PATENT DOCUMENTS

| | | | |
|---|---|---|---|
| JP | 54156536 | A * | 12/1979 |
| JP | 02235749 | A * | 9/1990 |

* cited by examiner

*Primary Examiner*—Manish Shah
*Assistant Examiner*—Leonard S. Liang

(57) ABSTRACT

In operating an inkjet printing mechanism, media passes through a printzone including a support apparatus supporting the media thereat. When passing through the printzone, print imaging is applied by application of ink from an ink dispensing element and onto a surface of the media. The method includes directing an airflow at the media surface, the airflow including a first directional component away from the printzone and a second directional component onto the media surface thereby urging the media against the support apparatus.

37 Claims, 10 Drawing Sheets

INK ASSIST AIR KNIFE

BACKGROUND OF THE INVENTION

The present invention relates generally to printing methods and apparatus, and can relate in certain aspects to ink drying methods and apparatus as applied in the context of inkjet printing operations.

Inkjet printing produces print imaging by propelling ink droplets onto media. A variety of inkjet printing mechanisms have evolved, but generally share in a common characteristic of rendering an image by depositing liquid ink, e.g., ink formulations including evaporatable components, on a media substrate. As such, inkjet printing methods and operations sometimes include drying of media, e.g., drying liquid ink to remove evaporatable components following application thereof to media. Thus, the "wet" nature of ink as applied to produce print imaging by inkjet printers has lead to the development of ink drying systems.

Inkjet drying techniques include passing media with wet print imaging against or near heated rollers and platens. Wet print imaging will smudge, however, if the drying apparatus contacts the print imaging. The application of heat energy and consequent drying of wet media when in a curved condition, i.e., as wrapped against a roller, often results in undesirable cockling and/or buckling or curvature of output. As a result, such media often suffers in quality and in some cases requires additional processing to flatten the media.

Generally, application of heat energy to wet ink volatilizes the ink and thereby dries print imaging produced thereby. Unfortunately, volatizing ink produces ink vapor which may contaminate a printing operation and may inhibit further drying. Volatilized ink compounds are sometimes carried away from a printing operation to reduce buildup of such compounds as volatilized or as settling back on or about various surfaces. Thus, some ink drying methods and apparatus contain or otherwise carry away volatized ink compounds to avoid contamination of the printing operation.

Volatilized ink compounds can inhibit further drying when accumulated at the media surface. Volatized ink compounds sometimes accumulate to form a boundary layer or cloud at the media surface. This body of volatilized ink sometimes inhibits further volatilization of ink and thereby sometimes inhibits further drying of print imaging.

Earlier ink drying systems avoid direct contact with print imaging while being dried. Paper transport mechanisms and other related paper handling paper mechanisms, e.g., such as to hold media well against a reference or support surface or platen, maintain a given distance between the printhead orifice plate and the media print surface. Direct contact with print imaging prior to it being suitably dry can result in undesirable smudging and degradation thereof, as was the case in earlier media handling systems, such as those using star-wheels in the media output path.

Ink formulations have been developed for improving drying time for inkjet printing applications. In addition to ink formulations, certain methods of printing have evolved to improve ink drying time in inkjet printing applications. As noted above, some inkjet printers include elaborate heating devices through or upon which media pass following application of print imaging. Ink formulations, drying mechanisms, and printing techniques directed toward improved ink drying time, however, sometimes present undesirable side effects. There can exist, therefore, a compromise between drying time and other print imaging quality requirements, as well as printing throughput, a performance rating usually measured in pages per minute.

Thus, many inkjet printing operations improve by reducing print image drying time. Preferably, this is accomplished without significantly compromising other print image quality requirements. Inkjet printing operations sometimes accomplish improvement by incorporating elaborate ink drying devices and methods. In some cases, fast-dry ink formulations, e.g., including special or more volatile evaporatable components provided for the purposes of ink drying, as opposed to print imaging purposes, have been used to improve ink drying time. Even inkjet printing operations including use of ink formulations having relatively fast drying time can benefit, however, by additional steps applied to print imaging to more quickly vaporize evaporative components thereof.

Printing operations making use of such fast-dry ink formulations do benefit, therefore, when drying procedures are applied to print imaging formed thereby. Expensive and elaborate ink drying systems, however, are not as easily justified for use in conjunction with expensive fast-dry inks. Given an investment in fast-dry inks, further investment in elaborate ink drying systems may be partially redundant and, to some extent, can in some cases represent an inefficient use of resources. As a result, ink drying systems typically are not used in conjunction with printing operations making use of expensive fast-dry inks.

SUMMARY OF THE INVENTION

In operating an inkjet printing mechanism, media passes through a printzone including a support apparatus supporting the media thereat. When passing through the printzone, print imaging is applied by application of ink from an ink dispensing element and onto a surface of the media. The method includes directing an airflow at the media surface, the airflow including a first directional component away from the printzone and a second directional component onto the media surface thereby urging the media against the support apparatus.

The subject matter of the present invention is particularly pointed out and distinctly claimed in the concluding portion of this specification. However, illustrated embodiments of both the organization and method of operation thereof may best be understood by reference to the following description taken with the accompanying drawings.

DETAILED DESCRIPTION OF THE PREFERRED EMBODIMENT

Figure 1:
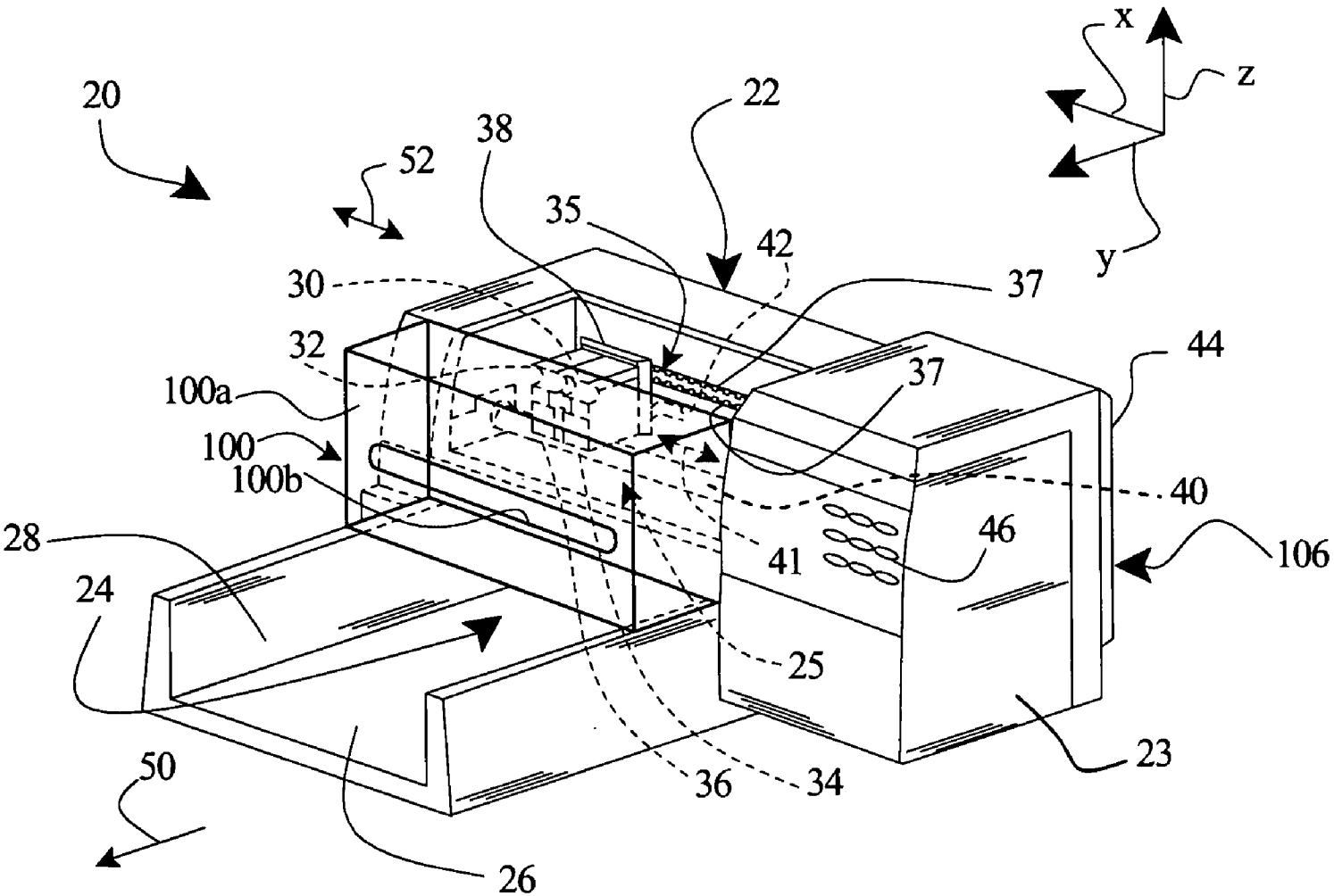
FIG. 1 illustrates an embodiment of an inkjet printing mechanism, here illustrated as an inkjet printer including one form of an ink drying system, here shown as a drying station.

FIG. 1 illustrates one embodiment of a typical inkjet printing mechanism, specifically an inkjet printer 20. The present invention will be illustrated in the context of or as applied to a typical inkjet printing mechanism, e.g. in the context of or as applied to inkjet printer 20 of FIG. 1. It will be understood, however, that printer components and particular component architectures vary from model to model and that the present invention applies across a variety of inkjet printing mechanism implementations even though not illustrated herein, such as plotters, photo imagers, facsimile machines, copiers, multi-function machines, etc.

Printer 20 includes a chassis 22 to which various printer components are mounted and then surrounded by a housing or casing 23. Within chassis 22 and casing 23, a print media handling system 24 supplies sheets of media (not shown in FIG. 1) to the printer 20. Media may be of a variety of generally sheet-form materials, such as plain, premium and photo paper, as well as transparencies, foils, fabrics, etc. but will be referenced herein as plain paper or media for the purpose of description. Handling system 24 moves media relative to a printzone 25 located along a feed path within chassis 22. The feed path begins at a feed tray 26 and ends at an output area 28. A variety of media transport mechanisms and techniques are known. Generally, such mechanisms and techniques include a picking device collecting individual media from tray 26 and a set of various driven and pinch rollers propelling media along the feed path, through printzone 25, and into output area 28.

As described more fully hereafter, printer 20 promotes drying of media following application of liquid ink as print imaging in printzone 25. As such, printer 20 operation will be described herein primarily with respect to media handling at or downstream from printzone 25, e.g., after or concurrent with application of print imaging to media therein.

In printzone 25, media moves longitudinally along the feed direction 50 and receives print imaging formed by projected ink droplets originating from an ink supply. In the particular embodiment illustrated herein, the ink supply is a replaceable inkjet cartridge, such as a black inkjet cartridge 30 and/or a tri-color inkjet cartridge 32. Generally, cartridges 30, 32, or "pens" as referenced by those familiar with the art, hold a selected ink formulation suitable for application to a selected media or particular print job. A variety of ink formulations have evolved across a variety of uses and variety of available media. It will be understood that the present invention is not limited to any particular method of ink supply or method of application of ink to form print imaging. Furthermore, the present invention is not limited to an inkjet printing mechanism including a non-stationary or reciprocating, e.g., moving or scanning, printhead such as shown herein for the purpose of illustration and indeed could be used with a stationary page-wide array (PWA) printhead which spans the entire printzone. For instance, while disposable inkjet cartridges are illustrated, tube-fed or "off-axis" ink delivery systems may be used, along with "snap-per" systems which employ semi-permanent printheads that receive ink from a replaceable supply which "snaps" onto the printhead.

Cartridges or pens 30 and 32 each carry a printhead, individually referenced as printheads 34 and 36, respectively, selectively projecting ink droplets toward printzone 25 to form a desired image. In this regard, cartridges or pens 30 and 32 may be considered as examples of fluid or ink dispensing elements. The present invention is not limited, however, to a particular form of ink dispensing element, the cartridges or pens 30 and 32 being illustrated herein for purposes of illustrating but one example of an embodiment of or context for the present invention. Each printhead 34 and 36, at its bottom surface, presents an orifice plate (not shown) with a plurality of nozzles formed therethrough. Printheads 34 and 36, for example, are thermal inkjet printheads. Other types of printheads include piezoelectric printheads. A broad spectrum of apparatus has evolved including replaceable cartridges such as cartridges or pens 30 and 32 as shown herein. Other apparatus including printheads may include ink supply devices coupled to separate printhead devices combined to form an ink dispensing device, stationary printheads, and various combinations thereof. It will be understood, therefore, that the present invention is not limited to a particular method or apparatus used to project or otherwise deposit or dispense ink droplets to form print imaging.

Printheads 34 and 36, implemented, for example, as thermal inkjet printheads, each include a plurality of resistors forming a resistive network associated with the printhead nozzles. Energizing a selected resistor quickly heats a portion of ink near a nozzle opening and, suddenly, a bubble of gas forms. In this manner, an inkjet nozzle "fires." The bubble propels or ejects a droplet of ink from the nozzle, e.g., propels ink positioned between the nozzle opening and heated resistor. The droplet flies toward a sheet of paper or media suitably positioned in printzone 25. Application of print imaging according to a given print job includes, for the particular example printer 20 illustrated herein, coordinating the position of cartridges or pens 30 and 32 within printzone 25 relative to the position of media within printzone 25 and "firing" the nozzle arrays within printheads 34 and 36 according to print imaging data, such as that received from a host device, for instance, a personal or other type of computer.

A carriage 38 holds cartridges or pens 30 and 32, along with the corresponding printheads 34 and 36, respectively. Carriage 38 reciprocates or "scans", e.g., moves laterally back and forth, relative to printzone 25. As noted above, however, the present invention is not limited to use of a scanning ink dispensing element as shown by example herein. For example, the present invention may be used in association with fixed, e.g., non-scanning, ink dispensing elements. Positioning cartridges or pens 30 and 32 during a print job includes controlled reciprocation through printzone 25 and along a scan axis 41. In this case scan axis 41 is parallel to a printer 20 lateral axis 52. A laterally-positionable carriage drive system, such as a motor-driven belt system 35 (shown partially) and a guide rod 40 establish movement of carriage 38 back and forth laterally through printzone 25. Guide rod 40, therefore, defines scanning axis 41 relative to printzone 25. More particularly, guide rod 40 may be a rigid smooth-surfaced structure along which carriage 38 rides. Belt system 35 couples to carriage 38 and moves carriage 38 reciprocally back and forth through printzone 25. In this particular inkjet printing mechanism, belt system 35 includes a laterally disposed toothed belt 37 suspended between, for example, a driven gear (not shown) near one end of printzone 25 and an idling gear (not shown) at the opposite end of printzone 25. Thus, coupling carriage 38 to belt 37 and driving belt 37 propels carriage 38 reciprocally as a belt system motor (not shown) alternates directions of rotation for belt 37. An encoder system, such as a known optical encoder system (not shown) may be used to provide feedback signals as to the actual positions of the carriage 38 along printzone 25.

Cartridges or pens 30 and 32 selectively dispense one or more ink droplets for deposit on print media located in the printzone 25 in accordance with instructions received via a conductor strip 42 from a printer controller, such as a microprocessor or control electronics located somewhere within chassis 22 and referenced herein generally as printer controller 44. Controller 44 may receive an instruction signal including print imaging data from a host device, which is typically a computer, such as a personal computer.

A printhead carriage motor and a paper handling system drive motor (neither shown) may operate cooperatively in response to printer controller 44 and in manners known to those skilled in the art. The printer controller 44 may also operate in response to user inputs provided through a keypad 46. A monitor coupled to the host computer may be used to display visual information to an operator, such as the printer status or a particular program being run on the computer. Personal computers, their input devices, such as a keyboard and/or a mouse device, and monitors are all known to those skilled in the art.

Ink droplets projected onto media in printzone 25 as liquid sometimes benefit from a drying assist to aid in setting print imaging produced thereby. Fast-dry ink formulations have been developed for improving, e.g., reducing, drying time for inkjet printing applications. In addition to ink formulations, certain methods of printing have evolved to improve ink drying time in inkjet printing applications, such as drop depletion techniques. Further, some inkjet printers may include heating devices through which media pass before, during, or following application of print imaging. Such ink formulations, drying mechanisms, and printing techniques designed to improve ink drying time, however, sometimes present undesirable side effects. For example, such fast-dry ink formulations may present excessive or relatively greater costs relative to other ink formulations or pose printhead servicing challenges. Also, some types of vapors produced in conjunction with ink drying may present safety concerns relative to breathability or contamination of ambient air. Particularly in high-speed printing, such as used in the publishing industry, ink drying time may be a limiting factor to achieving higher throughput ratings, often measured in terms of pages per minute, or if roll-fed, in feet per minute. There typically exists some compromise between drying time, throughput, and other print imaging quality requirements.

A drying system, here shown as drying station 100, sits along output feed direction 50 just following printzone 25. By incorporating drying station 100 into printing operations conducted by printer 20, print imaging, e.g., liquid droplets deposited on media in printzone 25, more quickly achieves a suitably dry state for proper output from printer 20. In other words, printed output desirably reaches a certain level of dryness before release from printer 20 or for subsequent media handling operations, such as inverting a sheet for duplex (two-sided) printing. Drying station 100 can apply heat energy to printed media just following, e.g., downstream from, printzone 25 and thereby more quickly promote a suitably dry state thereof, e.g., suitably dry for release from printer 20. In addition to application of heat energy, drying station 100 can provide airflow promoting by air convection enhanced drying time relative to printed media just following, e.g., downstream from, printzone 25 and, in conjunction with application of heat energy, more quickly promotes a suitably dry state thereof. The illustrated location of drying station 100 may also assist in pre-heating the supply of media located in the feed tray 26, prior to entering printzone 25.

Figure 2:
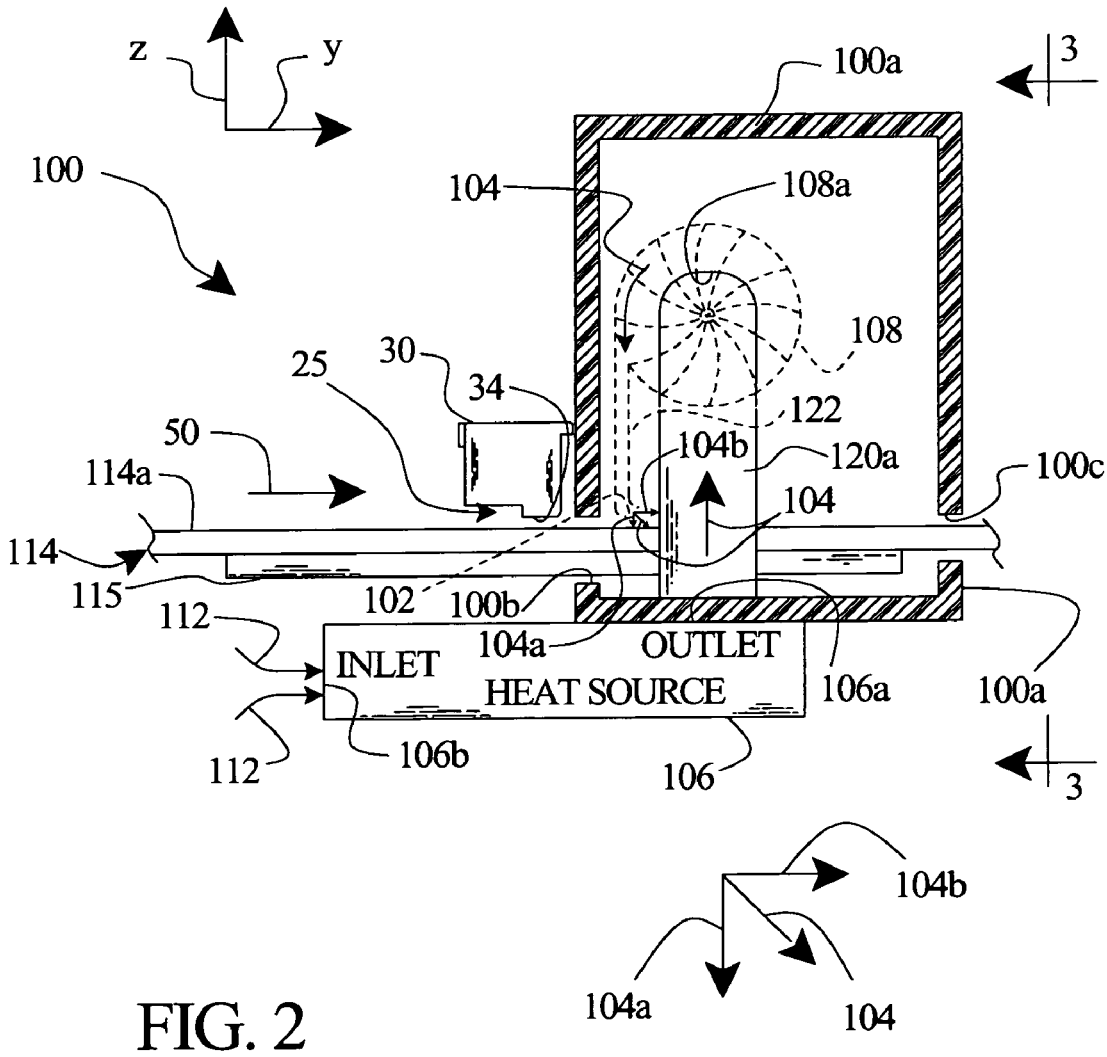
FIG. 2 is a side elevational view illustrating portions of the inkjet printer of FIG. 1 and the drying station of FIG. 1.

Though illustrated as a component of printer 20, it will be understood that drying station 100 as described herein may be provided as a separate drying unit through which media may be fed after application of print imaging thereon or as a retrofit unit for upgrading existing printing products. Drying station 100 including, for example, an internal media transport mechanism facilitates use as a separate unit, i.e., allows a user to insert media therein and feed media therethrough. As illustrated in FIG. 1, however, drying station 100 mounts to printer 20, operates within a shroud 100*a*, releases media output at slot 100*b*, and receives media input at slot 100*c* (FIG. 2). The present invention is not limited to use of shroud 100*a* and may be practiced with or without a shroud 100*a*, for instance, if incorporated to fit within a portion of casing 23. As may be appreciated, however, shroud 100*a* promotes more efficient collection and/or containment of vapors relative to evaporatable ink components produced during drying thereof.

Proper printhead-to-media spacing, or "pen-to-paper" spacing (PPS), as it is often referred to in the art is an important operating feature of an inkjet printing mechanism. As proposed herein, a well-directed airflow in the vicinity of but directed away from printzone 25 and onto media 114 promotes both improved media transport or handling and promotes print image drying. The angle of such airflow includes a component directed onto media 114 to bear down against media 114 and thereby maintain good contact between media 114 and a platen or support apparatus, such as surface 115*a* therebelow. Media 114 is thereby suitably and consistently spaced from printhead 34. Note that while a flat media support surface 115*a* is used for the purposes of illustration, the support may include anti-cockle ribs or features, or impart a bowed configuration to the media, such as a reverse-bow. As may be appreciated, operation of printheads 34 and 36 in application of print imaging to media 114 improves by maintaining suitable spacing between printheads 34, 36 and the exposed print surface 114*a* of media 114. An airflow directed into media 114 in the vicinity of printzone 25 aids in establishing and maintaining suitable pen-to-paper spacing (PPS) between printhead 34 and media 114. This establishes improved media handling following application of print imaging, but without use of direct contact with print imaging, which is particularly desirable in "full bleed" printing, where the image extends to the edges of the media without leaving un-printed margins.

Heat energy optionally introduced into the airflow further promotes ink drying. Application of such heated airflow near printzone 25, therefore, promotes drying of print imaging as applied in printzone 25. This provides efficient drying assistance, especially in the context of fast-dry inks. In the context of fast-dry inks, for example, a low product cost and low cost of operation ink drying apparatus represents efficient use of resources. Given an investment in fast-dry inks, use of low cost and low cost of operation drying apparatus may be justified when a more elaborate, e.g., more expensive and complex, drying apparatus is not necessary. It will be understood, however, that the present invention shall be not be limited in its broader aspects to use of a particular ink formulation, e.g., not necessarily limited to use in combination with fast-dry ink formulations.

Figure 3:
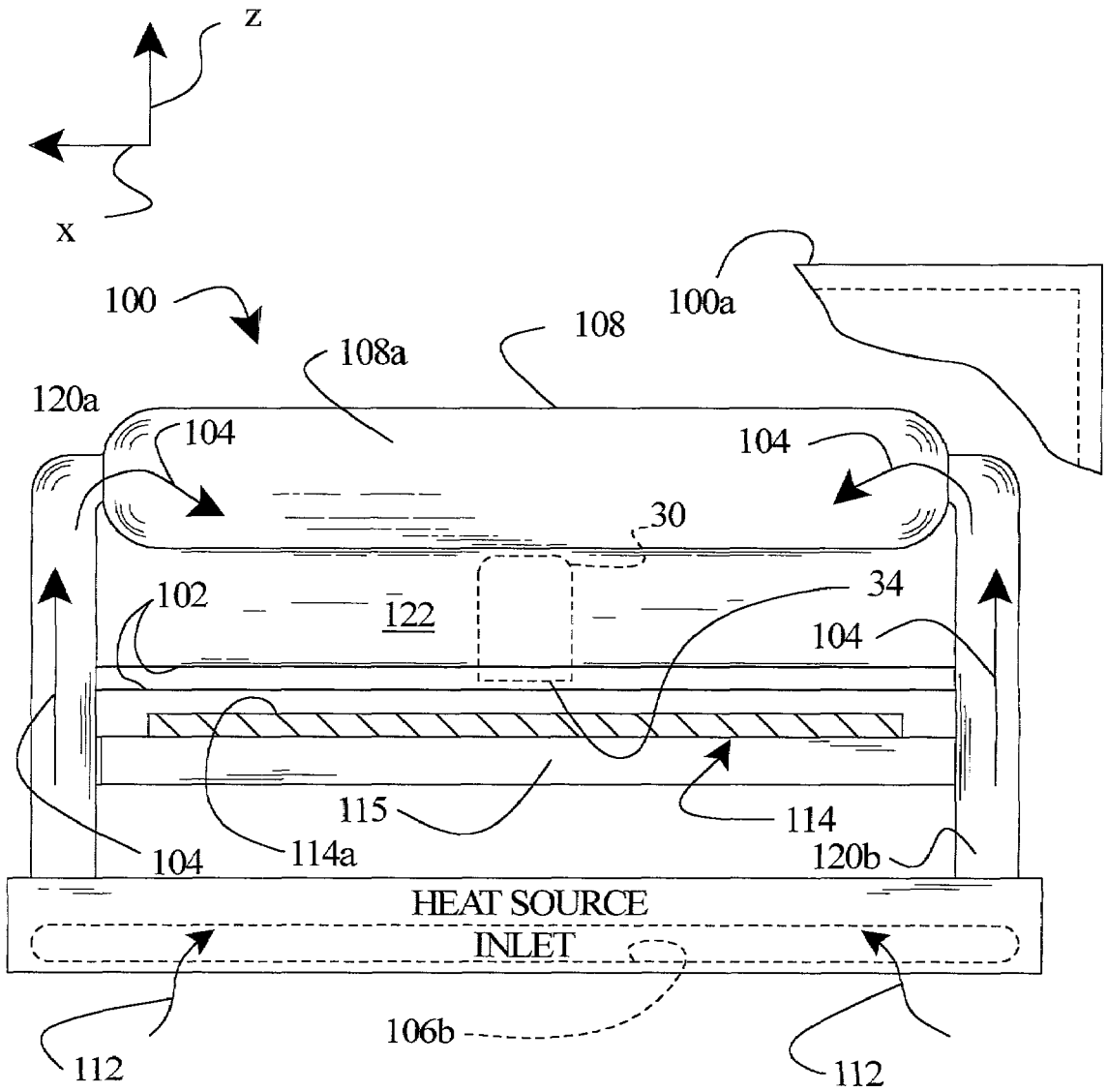
FIG. 3 is a front elevational view illustrating the printer components and drying station of FIG. 2 as taken along lines 3—3 of FIG. 2.

FIG. 2 illustrates in side view the drying station 100. FIG. 3 illustrates drying station 100 as viewed along lines 3—3 of FIG. 2. The shroud 100*a* as illustrated partially in FIGS. 2 and 3 optionally may be used to enclose or substantially enclose the components of drying station 100 as described more fully hereafter. For purposes of illustration, however, shroud 100*a* is shown partially in FIG. 3.

In FIGS. 2 and 3, cartridge or pen 30, including printhead 34, is shown in relation to media 114 resting upon the support platen 115. Similar positioning exists, for example, for cartridge or pen 32 and its printhead 36. Platen 115 is suitably spaced from printhead 34 to locate the print surface 114*a* of media 114 relative to printhead 34 for a selected PPS. Cartridge 30 projects ink droplets from printhead 34 according to a given print job to create print imaging in printzone 25. In this regard, print imaging quality improves when spacing between print surface 114*a* and printheads 34 and 36 is at a given distance, within an allowed tolerance from such given distance, and maintained substantially consistent during application of print imaging. Station 100 includes an outlet port or vent 102 located just downstream, e.g., along feed direction 50, from printzone 25. Preferably, vent 102 has a restricted or venturii construction, as well as an angled outlet port relative to the media surface 114*a* to act as an air knife whereby the velocity of airflow 104 is greater at vent 102 relative to upstream portions. Airflow 104 exits vent 102 with a first directional component 104*a* toward print surface 114*a* of media 114, and a second directional component 104*b* away from printzone 25, e.g., along feed direction 50, illustrated as vector components, with component 104*a* being for this particular illustration in the negative Z-axis direction and component 104*b* being in the positive Y-axis direction. Airflow component 104*a*, as presented from vent 102, bears downward against media surface 114*a* and maintains media 114 in good contact with platen 115 to maintain PPS in nearby printzone 25. Airflow component 104*b* promotes drying of print imaging in the vicinity of vent 102, and when directed away from printzone 25 assists in drying while introducing little air turbulence in printzone 25 and, therefore, introducing little effect on ink droplet trajectories therethrough. While the illustrated embodiment shows airflow components 104*a* and 104*b* as being relatively equal, due to an approximate 45 degree orientation of airflow 104 with respect to media surface 114*a*, other orientations of vent 102 may be used in other implementations to produce airflow components 104*a* and 104*b* having different force vectors, such as a greater magnitude component 104*a* where maintaining PPS is a greater concern.

Station 100 optionally makes use of a heat source 106. An air transport, in this particular embodiment a blower 108, pulls airflow 104 from an outlet 106*a* of heat source 106. Heat source 106 includes an inlet vent 106*b*. As blower 108 pulls airflow 104 from heat source 106, intake airflow 112 enters vent 106*b*, passes through heat source 106, and thereby collects heat energy to provide airflow 104 at outlet 106*a*. Airflow 104 travels up conduits 120*a* and 120*b* from heat source outlet 106*a* to blower inlet 108*a*. Blower 108 applies the warmed airflow 104 to vent 102 of conduit 122. It will be understood, however, that the present invention is not limited to an airflow system pulling air from outlet 106*a* of heat source 106. For example, air may be pushed into heat source 106, for instance by employing alternatively located fan or blower units, and thereafter through conduits 120*a* and 120*b* and ultimately out of vent 102 of conduit 122.

Thus, an overall airflow including airflows 112 and 104 originates, in this particular embodiment, in an ambient or surrounding air body and collects heat energy therealong for application at vent 102 as warmed airflow 104 just downstream from printzone 25.

Heat source 106 may take a variety of forms. As applied in the context of fast-dry ink formulations, for example, the amount of heat energy useful for productive drying assistance is substantially less than other more elaborate ink drying systems or those used with slower-drying ink formulations. Printer controller 44 constitutes a significant heat source for station 100 as applied in certain printing operations, e.g., such as in fast-dry ink formulations. As such, heat source 106 may include an enclosure for controller 44, e.g., defined by chassis 22 and casing 23, and serve as an electronics cooling system as well. In other words, heat source 106 can collect otherwise wasted heat energy from controller 44 and incorporate it into an airflow therethrough. While not specifically illustrated in FIG. 1, it will be understood that conduits 120*a* and 120*b* may be routed along a variety of paths through chassis 22 from controller 44 to blower 108. In addition to controller 44, a variety of other heat energy sources may be used as source 106 and may be accessed to collect what would otherwise be considered waste heat and thereby recycle such energy for use in ink drying assistance. For example, printer 20 may include motor components producing heat energy as a byproduct, but as a source 106 in one example of an embodiment of the present invention providing heat energy as an ink drying mechanism. Generally, collecting such waste heat energy has the further advantage of providing a cooling function relative to such components. In this respect, use of such waste heat energy as applied for ink drying represents the dual function of ink drying and printer mechanism component cooling.

Heat source 106 may also be provided with the sole function of producing heat energy for application to an airflow therethrough, e.g., a dedicated heater as opposed to heat-producing components of a printer mechanism providing other functions such as electronic control or motor operations. In other words, heat source 106 can be provided as an active heating element such as by heating elements including resistive elements passing electrical current therethrough with no other active, e.g., control, role in printer 20 operation.

It will be understood, therefore, that heat source 106 may take a variety of forms including controller 44, additional active heating elements, e.g., heating elements such as resistive elements passing current therethrough and playing no other active role in the operation of printer 20, and other heat producing components of printer 20 or various combinations thereof.

Vent 102, in the particular embodiment illustrated, takes the form of an elongate, thin opening extending laterally, substantially across the width of media 114, and generally along the scan axis 41. As discussed above, vent 102 geometry advantageously produces selected directional components, 104*a* and 104*b*, in airflow 104 as it approaches print surface 114*a*, e.g., some generally normal or perpendicular to and some relatively parallel to print surface 114*a*. That is, in the illustrated embodiment, the vector representations 104*a* and 104*b* each represent directional components of airflow 104. Relative magnitudes can be indicated by the length of arrows 104*a* and 104*b* according to known engineering vector analysis techniques. It will be understood, therefore, that vent 102 structure may take a variety of specific geometries other than the specific shape illustrated herein to vary the force of magnitude and direction of components 104*a* and 104*b*. A relatively low volume airflow produced by blower 108 reaches higher velocity by constriction along, for example, conduit 122 and relative to, for example, conduits 120*a* and 120*b*.

Figure 8:
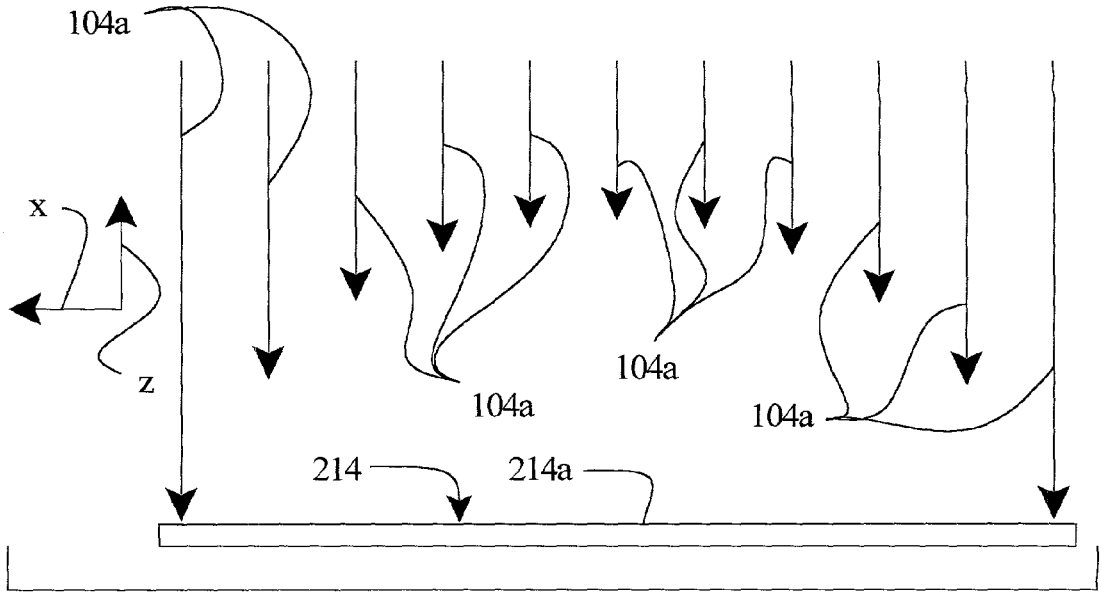
FIGS. 8 and 9 illustrate magnitude variation in airflow directional vector components across an air knife vent.
Figure 9:
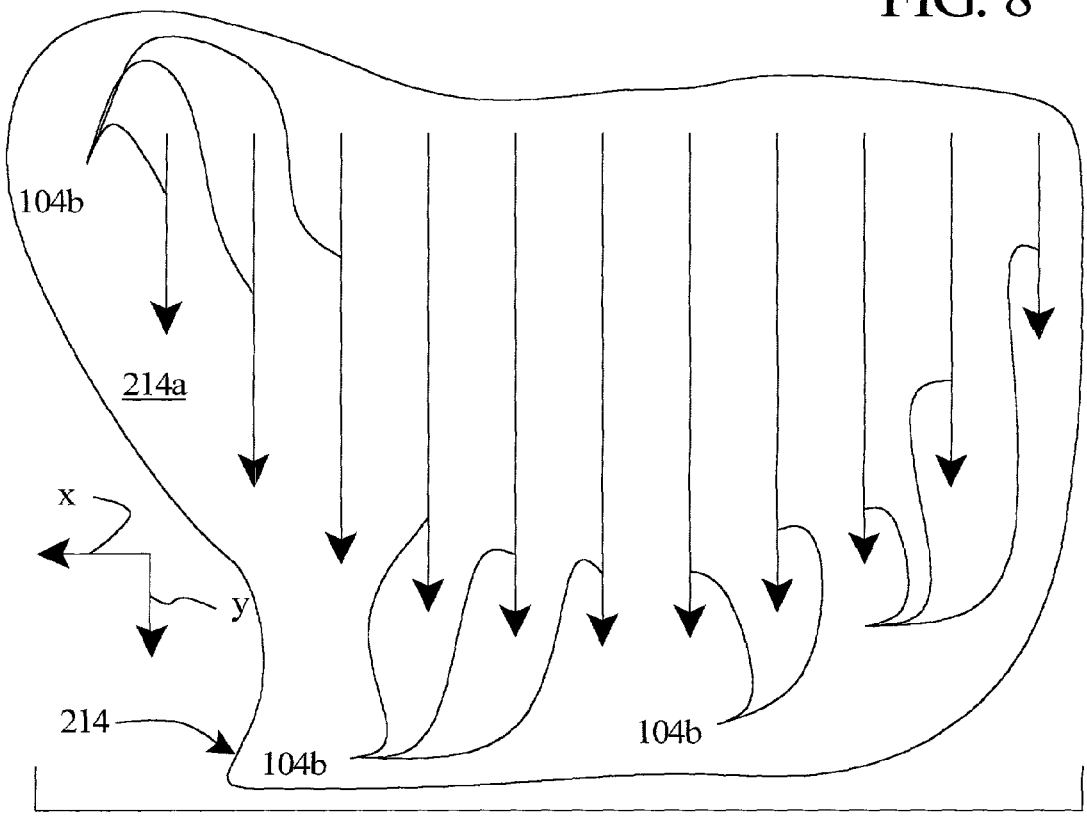

Moreover, the relative magnitude of components 104*a* and 104*b* may change over the width of a printzone or air knife vent. For instance, applying a relatively greater laterally directed component 104*b* in the laterally-central region of media 114, and applying a relatively greater media-directed component 104*a* at media 114 laterally-outward regions accomplishes variation in airflow 104 across an air knife vent or across a media surface. A greater magnitude component at the edges of media 114, for example, inhibits undesirable curling thereat. One example of such variation is illustrated in FIGS. 8 and 9 and discussed herein below.

Blower 108 need not necessarily possess significant capacity and may be implemented by a low-cost and power-efficient device. As such, blower 108 introduces significantly fewer undesirable acoustics such as the fan noise produced by more powerful, e.g., exhaust, fans. In other words, printer 20 as illustrated herein would not be considered noisy to its users because blower 108 can be substantially quiet and, therefore, more desirable relative to other more complex or powerful fan systems as used in more elaborate ink drying systems.

Figure 4:
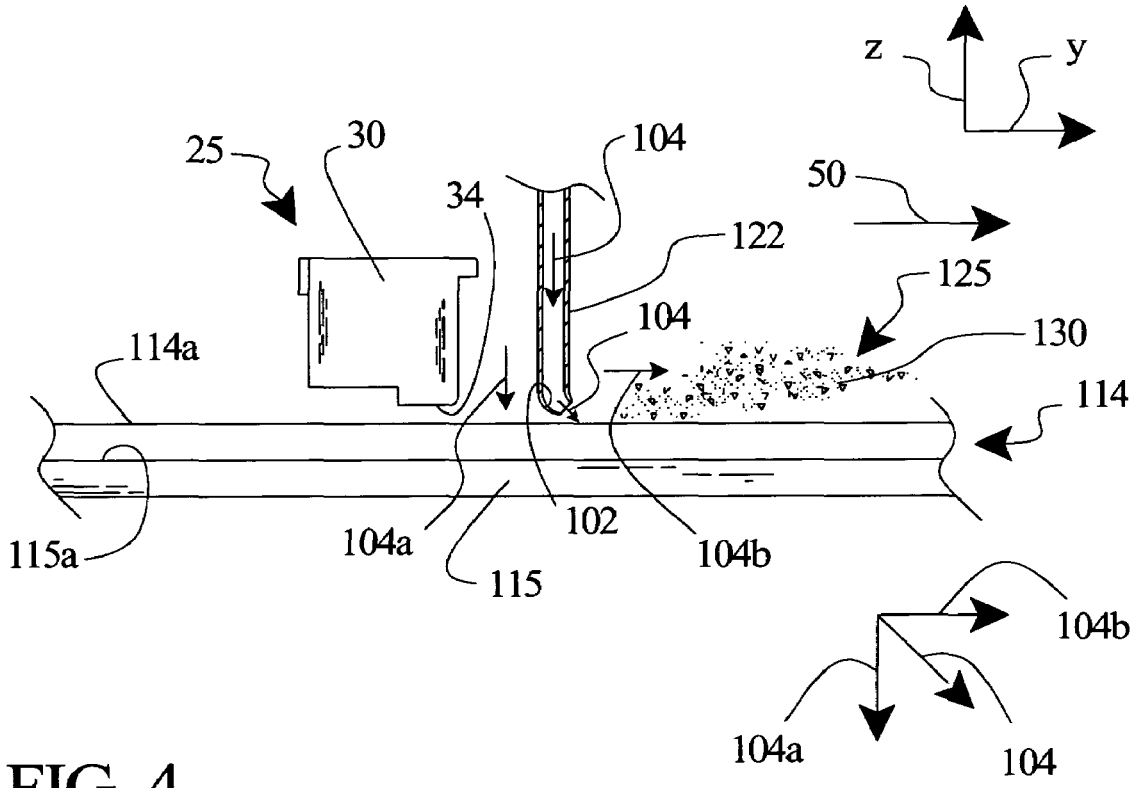
FIG 4 is a more detailed side elevational view of an embodiment of an air knife vent.

FIG. 4 illustrates in greater detail one example of a positional relationship between vent 102, airflow 104, printzone 25, media 114, and platen 115. FIG. 4 also illustrates an alternative mode of operation without use of a shroud 100*a*. In FIG. 4, the orientation of airflow 104 as it exits vent 102 includes components, e.g., directional vector components thereof, into print surface 114*a* of media 114. With media 114 resting directly upon platen 115, the resulting directional force vectors toward media 114 maintain and stabilize media 114 well against the supporting surface 115*a* of platen 115. With this region of media 114 experiencing such stabilizing directional force vectors near printzone 25, the spacing between, for example, printhead 34 and print surface 114*a* of media 114 remains desirably constant or at least well within allowed tolerances without requiring star-wheels or other output-side media hold-down devices that could damage the printed image.

FIG. 4 also illustrates a scrubbing action provided by airflow 104. More particularly, vent 102 provides a scrub zone 125 in its vicinity, e.g., downstream from vent 102 along feed direction 50. Airflow 104 disturbs a body of vaporized ink 130, thereby promoting more efficient drying of print imaging in scrub zone 125. When airflow 104 is warmed, improved ink drying also occurs in scrub zone 125 as print imaging is exposed to the elevated temperature of airflow 104.

The relative positioning of vent 102, printzone 25, orientation of airflow 104, and print surface 114*a* as illustrated by example in FIG. 4 may be used in a variety of implementations. For example, in particular embodiments illustrated herein, cartridge 30 reciprocates relative to media 114, e.g., along scan axis 41 (FIG. 1) generally transverse to feed direction 50 and conduit 122 remains stationary with media 114 moving in relation thereto along the feed direction 50. In other embodiments, however, media 114 could be stationary, in which case cartridge 30 and conduit 122 along with vent 102 may be moveable. Generally, placing vent 102 in a position allowing airflow 104 access to just-applied print imaging assists in ink drying and in stabilizing media 114 relative to, for example, adjacent printheads 34 and 36.

Figure 5:
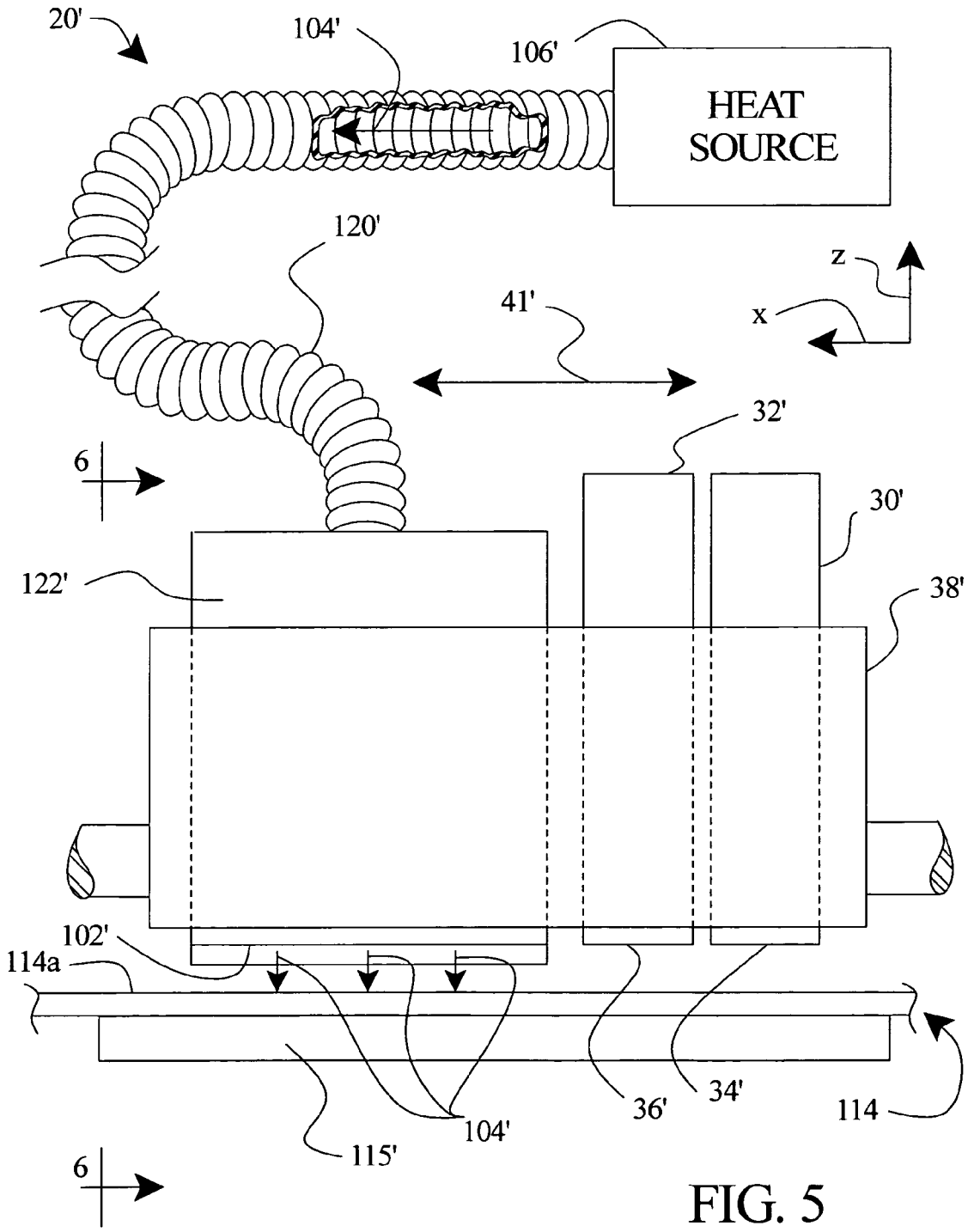
FIG. 5 is a front elevational view illustrating an alternative embodiment including air knife vent components moving generally along a printhead scan axis.
Figure 6:
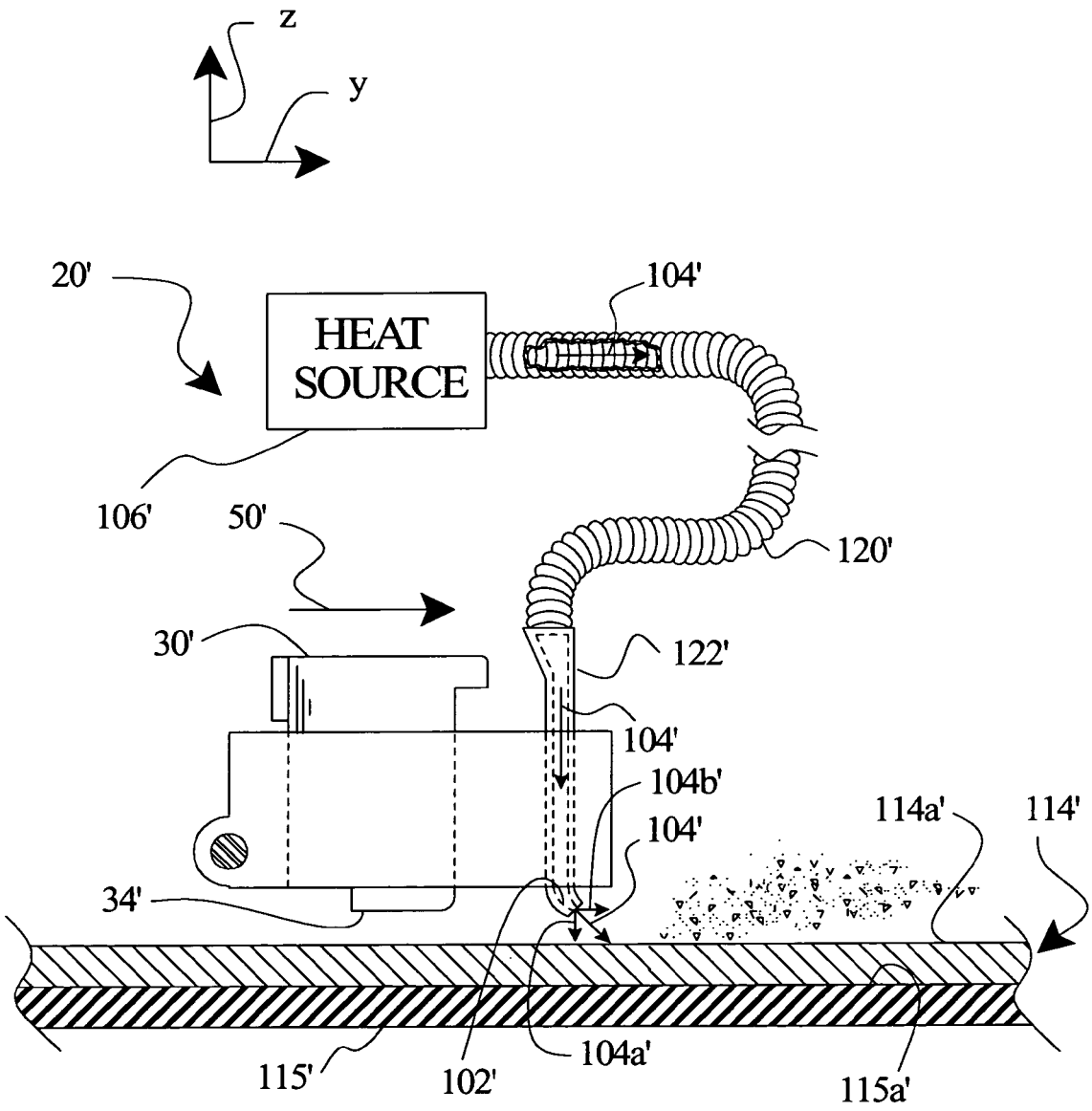
FIG. 6 is a side elevational view illustrating the alternative embodiment of FIG. 5 as taken along lines 6—6 of FIG. 5.

FIG. 5 illustrates a modified inkjet printer 20' including a moving conduit 122' and vent 102'. FIG. 6 illustrates the modified inkjet printer 20' as taken along lines 6—6 of FIG. 5. Inkjet printer 20' may be implemented substantially as described with respect to inkjet printer 20 but may be further enhanced by incorporating on a carriage 38' a conduit 122'.

Conduit 122' presents at its vent 102' warmed airflow 104'. Warmed airflow 104' originates from a heat source 106' substantially as described relative to heat source 106 above, but coupled to conduit 122' by way of a flexible conduit 120'. As may be appreciated, heat source 106' may be positioned in a variety of locations throughout inkjet printer 20' but provides airflow 104' to the reciprocating carriage 38' by way of a flexible conduit 120' to accommodate the movement of conduit 122' as it scans or reciprocates, for example, on carriage 38'. As may be appreciated, vent 102' propels airflow 104' in a direction generally away from printing operations at printheads 34 and 36, e.g., including in this example directional vector component 104*b'* along feed direction 50 and component 104*a'* onto surface 114*a* of media 114 so as to better maintain media 114 against surface 115*a'* of the support platen 115'.

Figure 7:
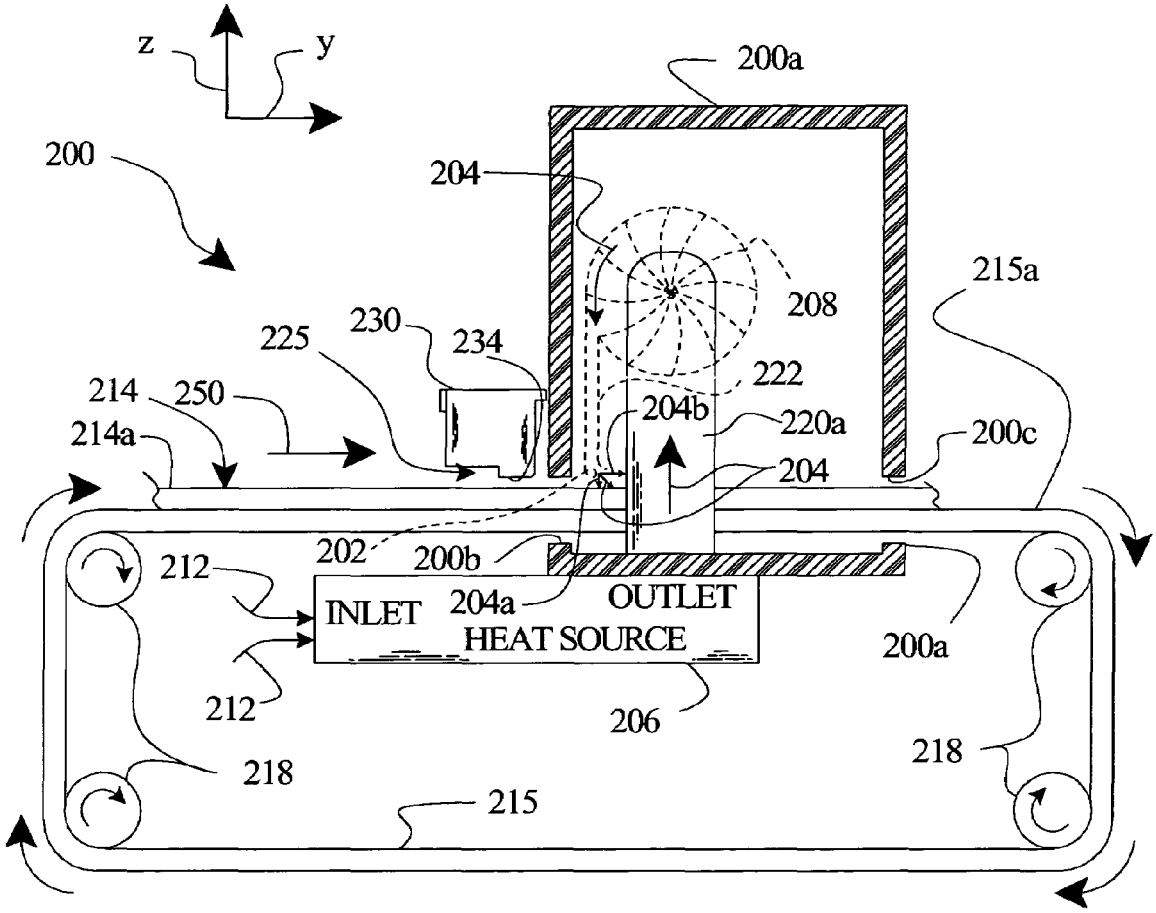
FIG. 7 is a side elevational view partially illustrating an alternative embodiment of an inkjet printing mechanism, here illustrated as an inkjet printer including and alternative form of an ink drying station.

FIG. 7 illustrates a modified ink drying system, shown in FIG. 7 as ink drying station 200. In FIG. 7, station 200 includes a shroud 200*a* with an intake slot 200*b* and output slot 200*c* through which media 214*a* pass along the feed direction 250 through shroud 200*a*. Within shroud 200*a*, airflow 204 exits vent 202 including components 204*a* and 204*b*. Component 204*a* is directed into print surface 214*a* of media 214 and component 204*b* is directed away from printzone 225 of a printhead 234 for an inkjet cartridge 230. In other words, airflow 204 urges media 214*a* well against a support apparatus therebelow, in this case a motor-driven support belt 215 also passing through shroud 200*a* at slots 200*b* and 200*c* and carrying media 214 thereon. A blower 208 receives the airflow 204 from a heat source 206. An intake airflow 212 passing through or adjacent to heat source 206 collects heat energy therein and passes along conduits 220 of station 200 for delivery at vent or air knife 202 by way of conduit 222.

Belt 215 rests on a set of support gears or wheels 218 suitably driven and coupled to belt 215 for propelling the media support surface 215*a* of belt 215 in the feed direction 250 through printzone 225, through shroud 200*a*, and on to an output area (not shown in FIG. 7). In other respects, e.g., movement of airflow 204 for presentation at vent 204, station 200 operates in substantially similar fashion as that of station 100 as described above. As may be appreciated, station 200 also exhibits an ability to hold media 114 well against belt 215 in the vicinity of printzone 225 and thereby consistently maintain pen-to-paper (PPS) therebetween. Belt 215 can be perforated to prevent capture of air between media 214 and belt 215 and thereby establish a selected PPS at printhead 234. Further, such force of media 214 against belt 215 frictionally couples together media 214 and belt 215 for propelling media 214 along with belt 215 in the feed direction 250.

FIGS. 8 and 9 illustrate variation in directional component magnitude across the width of media 114. More particularly, in FIG. 8 a plurality of directional vectors 104*a* are shown having greater magnitude as applied to the laterally-outermost edges of media 114. FIG. 9 illustrates the other directional components 104*b* having correspondingly smaller magnitudes at the laterally-outmost edges of media 114 and relatively greater magnitude in the central region of media 114. Thus, FIGS. 8 and 9 illustrate variation in directional component magnitude across an air knife vent and across the width of media 114.

Achieving the illustrated magnitude variation in directional components 104*a* and 104*b* as shown in FIGS. 8 and 9 may be accomplished by a variety of particular structural features of an air knife vent. Accordingly, variation in cross sectional area as well as directional or guide surface features of portions of conduit 122 and vent 102 can be fashioned to produce the variation in components 104*a* and 104*b* as illustrated herein. Furthermore, it will be understood that additional and different variations in components 104*a* and 104*b* may be accomplished for similar but distinct purposes. For example, in some applications it may be desirable to apply a greater magnitude directional component 104*a* in the central region of media 114 and similarly apply a greater magnitude component 104*b* near the laterally-outmost portions of media 114. It will be understood, therefore, that variation in components 104*a* and 104*b* across the width of an air knife vent or media 214 may be achieved for a variety of purposes and in a variety of configurations according to a particular embodiment. The present invention will not limited, therefore, to a particular arrangement of component 104*a* and 104*b* variation such as those particular arrangements illustrated or described herein for purposes of description. Furthermore, variation in components 104*a* and 104*b* as illustrated in FIGS. 8 and 9 are applicable to variations in such components across other air knife vents such as provided by the embodiment of FIGS. 5 and 6 and for the components 204*a* and 204*b* of the embodiment of FIG. 7. Similarly, such variation can be applied across vent 302 of the embodiment shown in FIG. 10 and vents 402 in the embodiment of FIG. 11.

Figure 10:
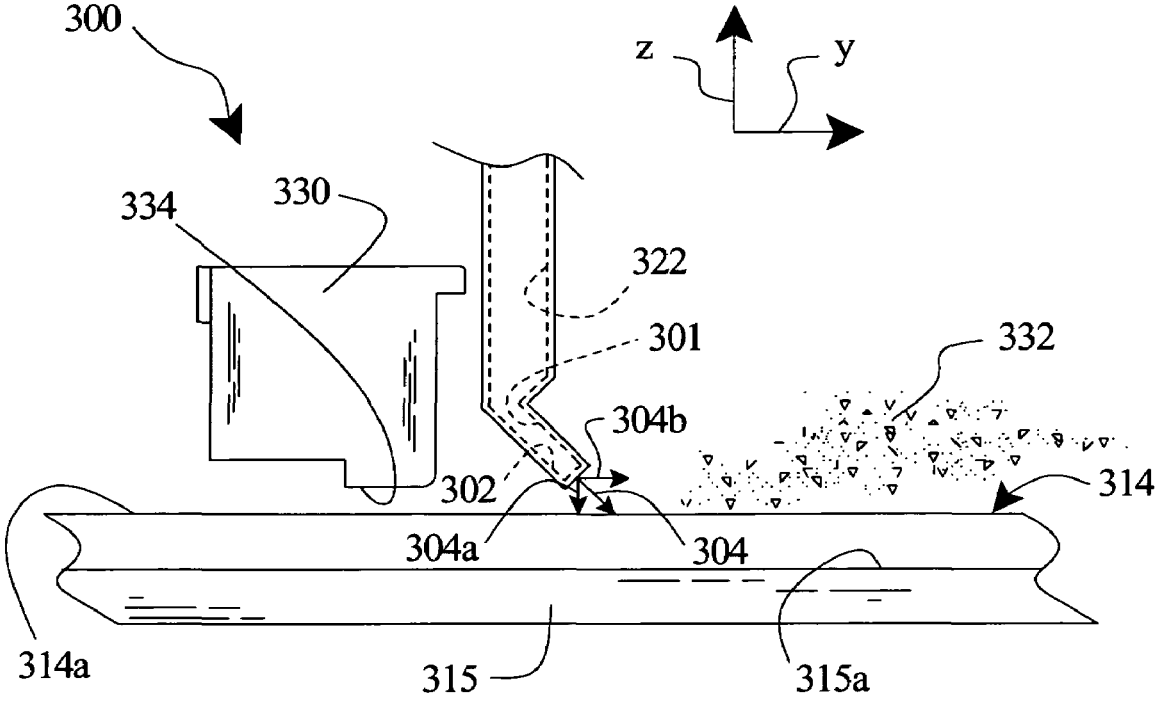
FIG. 10 illustrates a portion of an alternate embodiment of an ink drying system.

FIG. 10 illustrates an alternative drying system 300 operating relative to an inkjet cartridge 330 projecting from its printhead 334 ink droplets onto surface 314*a* of media 314 as supported therebelow on surface 315*a* of a support apparatus 315. An airflow 304 is provided along a conduit 322 and finds constriction as conduit 322 directs airflow 304 into a generally planar constriction 301 ultimately opening at vent 302. As may be appreciated, constriction 301 is of substantially less cross sectional area relative to conduit 322 and thereby promotes increased velocity and concentration of airflow 304 through constriction 301 whereby upon exit at vent 302 airflow 304 enjoys a directional component 304*a* onto surface 314*a* of media 314 to urge media 314 well against surface 315*a*. Airflow 304 further enjoys a directional component 304*b* generally along the surface of media 314 thereby providing a scrubbing action against a cloud of vaporized ink 332 thereat. Generally, airflow 304 assumes a substantially straight and organized path through planar restriction 301 and thereby assumes a generally well directed and organized condition for presentation as desired at vent 302. As may be appreciated, variation in the structure of constriction 301 and vent 302 therealong may be implemented to achieve variation in the relative magnitude of components 304*a* and 304*b* for different portions of vent 302 previously illustrated, for example, in FIGS. 8 and 9.

While illustrated in FIGS. 5 and 6 as adjacent cartridges 30' and 32' on carriage 38', e.g., offset along scanning axis 41', the relative position of conduit 122' and printheads 34' and 36' may be varied. For example, vent 102' may be offset along feed direction 50' (FIG. 6) for placement directly downstream from printheads 34' and 36', e.g., downstream relative to feed direction 50'. Conduit 122' may be located on an opposite side of cartridges or pens 30' and 32', intermediate cartridges or pens 30' and 32'. Furthermore, multiple conduits 122' may be distributed in and about carriage 38' to establish multiple airflows 104' as described herein.

Figure 11:
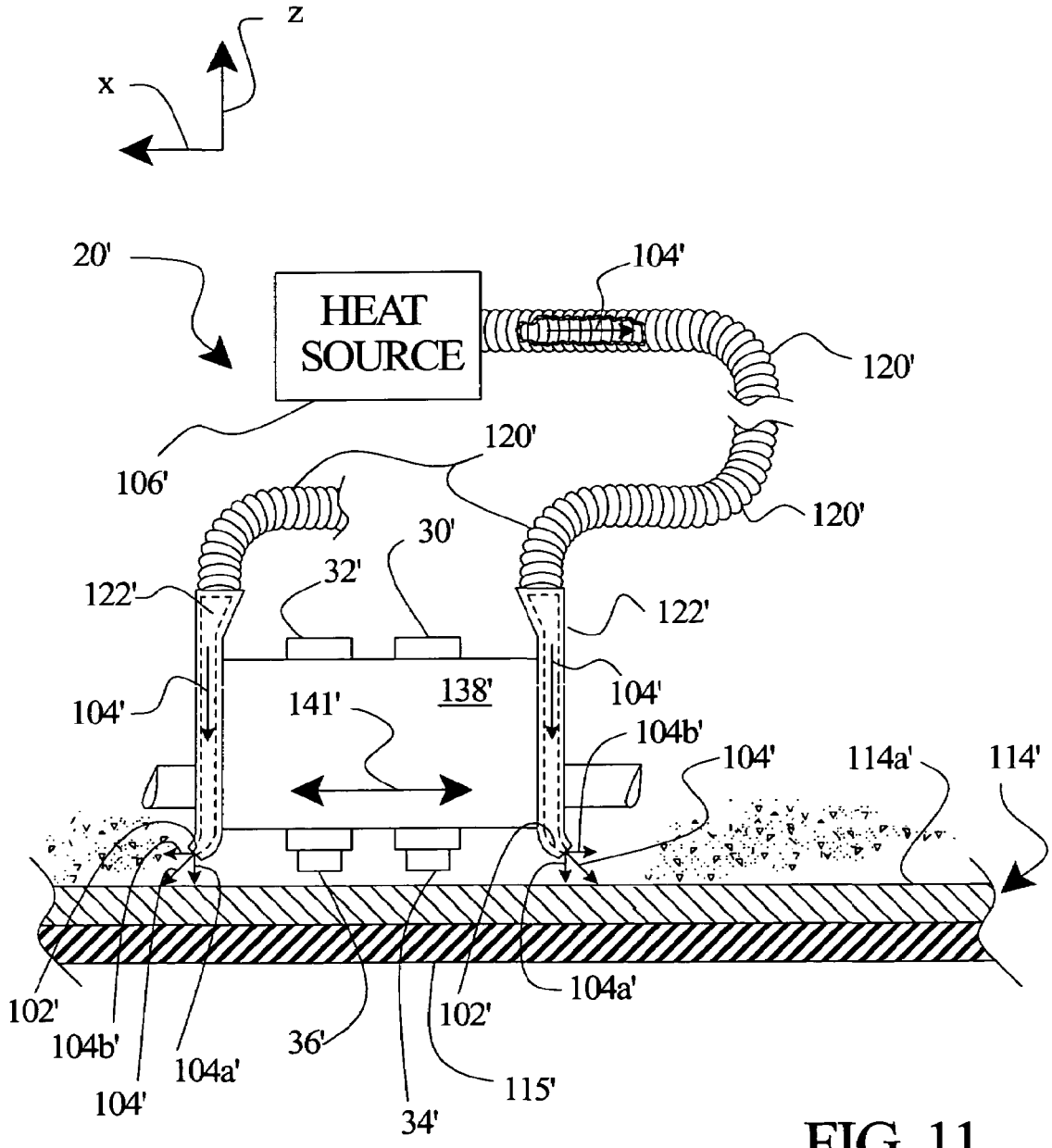
FIG. 11 illustrates another alternative embodiment of an ink drying system.

FIG. 11, for example, illustrates a modified form of scanning or non-stationary air knife similar to that illustrated in FIGS. 5 and 6, but repositioning conduit 122' and the orientation of vent 102' to provide a laterally-outward directed directional component 104*b'*. The media-directed component 104*a'* remains onto surface 114*a'* of media 114 and thereby holds media 114' well against surface 115*a'* of support apparatus 115'. Additionally, a second conduit 122' and vent 102' is added to carriage 138', also providing an airflow 104' with a directional component 104*b'* directed laterally-outward and a component 104*a'* directed into media 114'. In other words, the embodiment of FIG. 11 shows a pair of conduits 122' each fed by a flexible conduit 120' and presenting an airflow 104' at its vent 102' with one of vents 102' presenting a directional component 104*b'* opposite that of the other one of vents 102'. In this manner, as carriage 138' reciprocates along a scan axis 141', vents 102' provide airflow away from a printzone directly below printhead 34' of cartridge 30' and printhead 36' of cartridge 32'. Airflow thereby remains directed away from printing operations at printhead 34', yet also maintains media 114' well against support apparatus 115' in the vicinity of such printing operations. As may be appreciated, variation in the magnitude of components 104*a'* and 104*b'* may be established through a given vent 102' as discussed above and illustrated, as an example of such variation, in FIGS. 8 and 9.

Thus, an ink assist air knife has been shown and described. The air knife may be implemented by low cost, simple air transport device which can carry heat energy away from, for example, heat-producing printer components, and thereby introduce heat energy into an airflow positioned relative to printzone 25 while cooling the printer components. Directional or vector components 104*a* and 104*b* of such airflow into media 114 maintain good spacing between media 114 and, for example, printheads 34 and 36. Further, passing such airflow across fresh print imaging scrubs-away a saturated or semi-saturated boundary layer 130 of volatilized, e.g., evaporated, ink components to further assist in drying. Heat energy carried by such airflow further promotes ink drying. As a result, printer operation improves in both mechanical handling of media and in drying time for print imaging produced thereby yielding greater throughput rates without sacrificing image quality.

It will be appreciated that the present invention is not restricted to the particular embodiments that have been described and illustrated, and that variations may be made therein without departing from the scope of the invention as found in the appended claims and equivalents thereof.

What is claimed is:

1. A method of operating an inkjet printing mechanism, the method comprising:

passing media through a print zone, said print zone including a support apparatus supporting said media thereat;

during said passing, applying in a print zone print imaging by application of ink from an ink dispensing element and onto a first surface of said media; and directing an airflow at said first surface prior to the first surface being contacted by a structure downstream of the print zone, said airflow including a first directional component away from said print zone so as to not intersect the print zone and a second directional component into said first surface, said second directional component urging at least a portion of said media against said support apparatus in said print zone, wherein said airflow carries heat energy taken from a heat source performing a function other than heating air and otherwise producing waste heat energy.

2. A method according to claim 1 wherein said airflow is directed from an elongate vent.

3. A method according to claim 2 wherein a length dimension of said elongate vent is generally transverse to a media feed direction of said media passing through said print zone.

4. A method according to claim 2 wherein said length dimension of said elongate vent is substantially coincident with a width of said print zone.

5. A method according to claim 1 wherein said airflow carries heat energy taken from a heat source.

6. A method according to claim 5 wherein said heat source includes resistive elements carrying electrical current therethrough and having resistance thereto sufficient to produce elevated temperature in said airflow as said heat energy carried by said airflow moving therepast.

7. A method according to claim 6 wherein said resistive elements include electronic control circuit components serving also to support operation of an inkjet printer.

8. The method of claim 5, wherein the heat energy carried by the airflow preheats the media prior to the media entering the print zone and wherein the airflow is directed at the first surface after the first surface has passed through the print zone.

9. The method of claim 8, wherein the airflow carrying the heat energy preheats the media while the media is in a feed tray.

10. A method according to claim 1 wherein said airflow is provided from an elongate vent having a length dimension less than a width of said print zone.

11. A method according to claim 1 wherein said waste heat energy originates from electronic control circuit components.

12. A method according to claim 1 wherein said waste heat energy originates from motor components.

13. A method according to claim 1 wherein directing said airflow includes directing said airflow from a vent located on a carriage of an inkjet printer, and said applying comprises carrying said dispensing element.

14. A method according to claim 13 wherein said carrying comprises reciprocating said carriage laterally relative to a feed direction of said media passing through said print zone.

15. A method according to claim 1 wherein said second directional component is of sufficient magnitude to maintain said media against said support surface in said print zone.

16. A method according to claim 15 wherein said second directional component is directed away from said print zone.

17. A method according to claim 1 wherein said first directional component is substantially uniform across said media in a direction generally transverse to a feed direction of said media passing through said print zone.

18. A method according to claim 17 wherein said second directional component varies in a direction generally lateral to a direction of said media passing through said print zone and has greater magnitude at a laterally-outermost portion of said media relative to a laterally-central portion of said media.

19. A method according to claim 1 wherein said first directional component varies across said media in a direction generally transverse to a direction of said media passing through said print zone.

20. The method of claim 19, wherein the airflow is directed from a vent having an opening between the ink dispensing element and the first surface of the media.

21. A method according to claim 1 wherein the airflow is directed from a vent having an opening between the ink dispensing element and the first surface of the media.

22. A method according to claim 1 wherein the media is passed through the print zone in a first direction and wherein the first directional component is in the first direction.

23. A method according to claim 1 wherein the airflow is directed through a conduit extending towards the first surface and terminating at a vent proximate to and angularly facing the first surface.

24. A method of claim 23 wherein the ink dispensing element is provided by a printhead at a first end of a cartridge having a second opposite end, wherein the conduit extends from the first end to the second end.

25. A method according to claim 1 including varying a magnitude of the airflow across the first surface.

26. A method according to claim 25 wherein the media is passed through the print zone in a first longitudinal direction, wherein a media has a central region and a lateral edge and wherein the first directional component of the airflow is directed at the first surface with a first magnitude at the central portion and with a second greater magnitude at the lateral edge.

27. A method according to claim 25 wherein the media is passed through the print zone in a longitudinal direction, wherein the media has a central region and lateral edges and wherein the second directional component of the airflow has a first magnitude at the lateral edge and a second greater magnitude at the central region.

28. The method of claim 1, wherein the airflow is directed at the first surface and at the support apparatus underlying the first surface.

29. The method of claim 1, wherein the media is passed through the print zone relative to the support which is stationary.

30. A printing mechanism comprising:

a printhead configured to selectively eject fluid printing material onto a print surface in a print zone;

a pressurized air source having an opening proximate the print surface and angularly facing away from print zone so as to direct pressurized air against the print surface to stabilize the print surface within the print zone and such that pressurized air does not intersect the print zone, wherein pressurized air is directed through a conduit extending towards the print surface and terminating at the opening and wherein the mechanism further comprises a cartridge providing the printhead at a first end having a second opposite end, wherein the conduit extends from the first end to the second end.

31. The print mechanism of claim 30 wherein the airflow is directed from a vent having an opening between the printhead and the print surface.

32. The print mechanism of claim 30 wherein the print surface is passed through the print zone in a first direction and wherein the opening angularly faces in the first direction.

33. The print mechanism of claim 30 including varying a magnitude of the airflow across the print surface.

34. The print mechanism of claim 33 wherein the print surface is passed through the print zone in a first longitudinal direction, wherein the print surface has a central region and a lateral edge and wherein airflow from the pressurized air source has a directional component directed at the first surface with a first magnitude at the central portion and a second greater magnitude at the lateral edge.

35. The print mechanism of claim 33 wherein the print surface passes through the print zone in a longitudinal direction, wherein the print surface has a central region and lateral edges and wherein airflow from the pressurized air source has a directional component away from the print zone with a first magnitude at the lateral edge and a second greater magnitude at the central region.

36. A method of operating an inkjet printing mechanism, the method comprising:

passing media through a print zone, said print zone including a support apparatus supporting said media thereat;

during said passing, applying in a print zone print imaging by application of ink from an ink dispensing element and onto a first surface of said media; and directing an airflow at said first surface, said airflow including a first directional component away from said printzone so as to not intersect the printzone and a second directional component into said first surface, said second directional component urging at least a portion of said media against said support apparatus in said printzone, wherein said first directional component varies across said media in a direction generally transverse to a direction of said media passing through said printzone.

37. A method of operating an inkjet printing mechanism, the method comprising:

passing media through a print zone, said print zone including a support apparatus supporting said media thereat;

during said passing, applying in a print zone print imaging by application of ink from an ink dispensing element and onto a first surface of said media; and directing an airflow at said first surface, said airflow including a first directional component away from said print zone so as to not intersect the print zone and a second directional component into said first surface, said second directional component urging at least a portion of said media against said support apparatus in said print zone, wherein the airflow is directed through a conduit extending towards the first surface and terminating at a vent proximate to and angularly facing the first surface, wherein the ink dispensing element is provided by a printhead at a first end of a cartridge having a second opposite end and wherein the conduit extends from the first end to the second end.

* * * * *